US005816750A

United States Patent [19]

Steffenino

[11] Patent Number: 5,816,750

[45] Date of Patent: Oct. 6, 1998

[54] AUTOMATIC GRID LAYOUT SYSTEM

[75] Inventor: John E. Steffenino, Bristol, Tenn.

[73] Assignee: The Tensar Corporation, Atlanta, Ga.

[21] Appl. No.: 726,197

[22] Filed: Oct. 4, 1996

[51] Int. Cl.[6] ..... E21D 23/00; E21D 23/03

[52] U.S. Cl. ..... 405/302.3; 405/291; 405/299

[58] Field of Search ..... 405/258, 272, 405/288, 291, 296, 299, 302, 302.1, 302.3; 299/1.3, 11

[56] References Cited

U.S. PATENT DOCUMENTS

| | | | |
|---|---|---|---|
| 3,399,927 | 9/1968 | Groetschel | 299/11 |
| 4,099,785 | 7/1978 | Groetschel | 405/302.3 |
| 4,122,682 | 10/1978 | Groetschel | 299/11 X |
| 4,199,193 | 4/1980 | Damron et al. | 299/31 |
| 4,260,195 | 4/1981 | Hart | 299/11 |
| 4,299,043 | 11/1981 | Bell et al. | 299/11 X |
| 4,312,540 | 1/1982 | Thompson | 299/11 |
| 4,358,159 | 11/1982 | Groetschel | 405/302.3 X |
| 4,374,798 | 2/1983 | Mercer . | |
| 4,379,660 | 4/1983 | Groetschel | 405/302.3 |
| 4,753,486 | 6/1988 | LeBegue | 299/11 |
| 4,865,390 | 9/1989 | Shrader et al. | 299/11 |
| 5,096,335 | 3/1992 | Anderson et al. . | |
| 5,567,018 | 10/1996 | Hart | 405/299 X |

OTHER PUBLICATIONS

"Representation of a Mine", Consol Inc. 1992.

*Primary Examiner*—Tamara L. Graysay
*Assistant Examiner*—Tara L. Mayo
*Attorney, Agent, or Firm*—Jacobson, Price, Holman & Stern, PLLS

[57] ABSTRACT

A grid layout system including a grid dispenser mounted on a boom of a continuous miner for movement with a cutting drum to cut a passageway in a rock face. A roll of grid material, such as integral biaxially oriented geogrid, is fed from the dispenser and maintained under tension as it is positioned against the ceiling of the passageway to be secured thereto as a supplemental support. The tensioning device takes up any slack in the grid material during the cutting operation to preclude engagement of the grid material with the cutting drum. The edges of the grid material are longitudinally folded over the middle section and temporarily held in this manner to provide the roll of the grid material within the dispenser with a width less than the cutting drum. A spreader bar opens the grid material to its full width as it is dispensed.

34 Claims, 7 Drawing Sheets

74
62
68
64
72
88
86
70
66
90
86
78
76
80
71
84
82
74
86
70
72
86
70
86
88
90
70
70
88
62
64
90
68
66
52
54

AUTOMATIC GRID LAYOUT SYSTEM

FIELD OF THE INVENTION

The present invention relates to an automatic grid layout system for installing a grid or mesh sheet to fully cover the ceiling of a mine or tunnel passageway as a supplemental roof support during the material extraction operation. The supplemental roof support material is dispensed from a cartridge mounted on the boom of a continuous miner, with the grid sheet being tensioned as it is fed from the cartridge such that, upon detection of slack, excess grid is retracted into the dispenser cartridge to avoid entanglement with the cutter drum.

BACKGROUND OF THE INVENTION

The recovery of minerals from beneath the ground dates from prehistoric times. For thousands of years mining consisted of the excavation of outcropping material or tunneling more or less horizontally into mountainsides. Mining from deep shafts became possible only when reliable supports for tunnels along with drainage, ventilation and the use of mechanical appliances were developed.

Methods for the mining of mineral deposits differ from one another because of differences in geological conditions and location. However, all mines have certain features in common. Access to the deposit is gained either by a horizontal tunnel driven into a mountainside or by a vertical shaft. The deposit is then divided into sections of suitable size and shape for mining. After extensive preparatory work has been done, the actual mining may commence. The horizontal tunnels extending from a vertical shaft may be situated at vertical intervals of as much as 300 feet and more in deposits extending to great depths such as coal.

A well established method for the mining of sedimentary deposits occurring in coal seams is known as "longwall mining". By this method, coal is obtained from a continuous wall of up to 200 yards long by removal of a web of coal about 5 feet wide by the seam height. Areas of several hundred acres are completely extracted. Two variants of this method are in use. In the "retreating" system, roads are driven to the boundaries of the area to be mined. The faces are worked retreating to the winding shaft. In the "advancing" system, the faces are opened up at the shaft and then advanced to the boundaries.

In the United States the "room-and-pillar" method of coal mining is extensively used. Main entries are first made and from them rooms are driven. Between 30 and 50% of the coal is mined in this way during the "first working". Subsequently, the pillars of coal remaining are mined in the retreat, or "second working".

Due to the high proportion of wages in the cost of production, mechanization is very important in the mining industry. However, because of the often difficult conditions in which the product must be obtained, the scope for mechanization of the actual "production" process is limited.

An early development in mine mechanization was the introduction of locomotives to replace manual or pony haulage. Underground haulage in mine cars has in part been replaced by continuous conveying systems of various kinds such as belt conveyors, steel-apron conveyors, and chain conveyors, for example. These conveyors can handle up to 600 or 700 tons of material per hour in the horizontal direction at gradients up to about 12 degrees.

Underground drilling is now performed by large crawler-mounted power drills equipped with high-alloy-steel or tungsten carbide-tipped tools. These tools have swivel mountings and hydraulic feed mechanisms. They can drill blastholes at a rate of up to 30 m (100 feet) per minute.

Shearing machines or "shearers" are used to get most of the coal mined by the longwall system. A typical machine for longwall work has a jib provided with a cutting chain fitted with tungsten carbide-tipped cutter picks. The machine makes an approximately five-foot deep horizontal cut while resting on the floor and hauling itself via a drive sprocket acting on the face conveyor mechanism.

Another coal cutting system is a continuous mining system which employs a continuous miner having crawler tracks to advance a cutting tool. During the coal extraction process, the continuous miner is used to cut coal and other semi-hard material from the coal seam. The continuous miner, having the advantage of being mounted on two crawler tracks similar to a bull-dozer, propels itself and the connected rotating drum forward into the coal seam.

The cutting tool generally includes a drum which is raised and lowered at the mine face while a series of cutting teeth are rotated. The cutting drum is orientated horizontally on the front of the machine. In the case of a conventional miner bolter the cutting drum is 15 feet, 6 inches wide and 36 inches in diameter. The advancing miner thereby cuts a path of a defined width.

The coal as cut by the rotating drum is gathered by two rotating arms that feed the coal into a center conveyor. The conveyor then transports the material from the front of the machine to the rear where a shuttle car carries the coal to a belt.

Since the cutting head is generally only three or four feet in diameter and the coal seam can be as high as ten feet or more, the rotating drum must be initially located at the top of the seam and pushed into the seam by the two crawler tracks until the gathering mechanism reaches the coal face which stops the forward progress of the miner. Forward progress during one sump is approximately one-half the cutting head diameter.

At this point, the drum must be sheared or forced down through the coal until the rotating drum reaches the bottom of the seam. When the cutter drum reaches the bottom, the continuous miner must be reversed allowing the cusp to be cut. A cusp, or portion of uncut material, is always present between the drum and the front of the gathering mechanism which must be removed to ensure a smooth floor before the cutter drum can be raised. The removal of the cusp necessitates that the machine be trammed rearward while the drum is rotating. The drum is then raised and the sequence of coal cutting or "cycle" is repeated.

Loaders, or shuttle cars, or continuous haulage units are used to follow the continuous miners to convey material to the belt.

In order to protect the mine personnel and equipment, it is necessary to insure that the ceiling or roof of the tunnel be supported during and after the cutting operation. For safety and efficiency, the construction of supports for underground workings has also been mechanized. For example, in the use of a continuous miner, to help stabilize the mine roof, integrated roof bolters are carried on opposite sides of the machine. The roof bolters include a plurality of temporary roof supports (TSR) which are raised vertically to engage the roof of the mine located behind the cutter drum and above the miner operator during bolt installation. While supporting the roof with the TSR's, a roof bolt hole is made and an anchor bolt may be secured in the hole by a screw thread and nut which expands the two halves of a tapered split bushing.

An operator positioned on both sides of the continuous miner operates the integrated roof bolters. The space provided for the continuous miner operators is limited because the body of the continuous miner advancing the cutter drum is only slightly narrower in width than the cutting drum.

To ensure the stability of the mine roof, it is generally desirable to provide supplemental supports. These supports are typically installed within 30 minutes after mining a path by the continuous miner.

To install one form of supplemental roof support currently in use, after a 20–40 foot long path is cut by a continuous miner drum having a width of 15.5 feet the miner is backed out from its newly formed passageway. Thereafter, truss bolts are inserted at a diagonal to the mine passageway on opposite sides of the passageway. The bolts are inserted into the roof and a cable connected to opposed truss bolts with a turnbuckle to aid in stabilizing the mine roof.

Another form of supplemental roof support which has been proposed comprises installation of continuous lengths or sheets of material which may comprise metallic meshes or wire grids, but which are preferably polymer mesh materials. The preferred form of polymer mesh is a uniaxially or biaxially oriented integral structural geogrid of the type which is commercially available from The Tensar Corporation of Atlanta, Ga. ("Tensar"). Such materials are preferably made by the process disclosed in U.S. Pat. No. 4,374,798, the subject matter of which is incorporated herein in its entirety by reference. While a high density polyethylene biaxial integral structural geogrid of the type produced by the process disclosed in the '798 patent and sold by Tensar as its BX 3316 geogrid, is preferred, other polymerics may be substituted therefor and other forms of integral structural geogrid may also be used as supplemental roof support material according to this invention. Likewise, various bonded composite open mesh structural textiles including woven or knitted grid-like sheets such as disclosed in co-pending, commonly assigned U.S. patent application Ser. Nos. 08/643,182 and 08/696,604 filed May 9, 1996 and Aug. 14, 1996, respectively, the subject matter of which are also incorporated herein in their entirety by reference, are also useful.

Of particular interest are grid or mesh materials which have been treated with a fire resistant or fire retardant to preclude, or at least minimize, the possibility that the mesh material will initiate a spark or propagate a fire in a combustible underground environment such as a coal mine. Preferred materials of this type and the manner in which they have been used is discussed in some detail in commonly assigned U.S. Pat. No. 5,096,335 issued Mar. 17, 1992, the subject matter of which is incorporated herein in its entirety by reference.

While preferred grid-like supplemental roof supports are discussed herein, the instant inventive concepts are primarily related to the means for automatically storing and dispensing such materials in a continuous mining operation, and not the nature of the material itself.

Supplemental roof supports of the grid or mesh type may be manually installed with the miner/bolter in place or after withdrawal of the continuous miner. However, the manual lifting and handling of such material results in a substantial loss in time from the mining operation. In addition, there are inherent potential dangers from lifting accidents when such supplemental roof support material is installed in this way.

Attempts to mechanize the installation of a grid-type supplemental roof support material has had limited success. For example, with the use of one form of continuous miner and tunnelling machine, the Voist Alpine ABM 20, installation of polymer mesh during a production cycle has been accomplished by installing mesh rolls on the front end of the machine. However, the Voist miner is unique in design in that the polymer mesh does not have to be actively tensioned during the cutting operation to ensure proper installation because the outer frame of the machine does not cycle. Rather, as the cutting head is moved forward on an inner frame of the machine, the outer frame remains fixed. Only after the inner frame has been advanced, does the outer frame move forward to, in effect, catch up with the inner frame.

In most other continuous miners currently in use, including, for example, the Joy, Jeffrey, Long-Airdox and EIMCO cutters, the entire machine is advanced as the cutting operation is performed. With such devices, polymer grid material or the like fed from a roll mounted on the front of the machine would develop slack or droop, particularly as the equipment is withdrawn from a newly formed tunnel, quite likely being entangled in the rotating cutting mechanism as the mining operation proceeds.

Another problem commonly encountered in attempts to mechanize the installation of a polymer mesh supplemental roof support heretofore is the inability to cover the entire width of the mine tunnel ceiling. As mentioned above, the standard width of a continuous miner/bolter cutting drum is about 15 feet, 6 inches. Thus, this is the width of the tunnel ceiling cut thereby. Obviously, it is necessary for the width of the roll of mesh material carried by the miner to be less than the width of the tunnel in order that the sides of the roll do not bind on the sides of the tunnel as the continuous miner is moved forwardly or rearwardly during the mining operation. However, the use of a supplemental roof support material which is less than the full width of the tunnel results in unsupported side sections of the mine roof.

In addition to limiting the width of a roll of mesh material so as to enable the continuous miner to be freely moved in the tunnel, the preferred integral biaxial geogrids are generally available in widths substantially less than 15 feet, 6 inches.

Thus, for the foregoing, and other reasons, automatic application of grid or mesh supplemental roof support material capable of covering the entire tunnel ceiling has not been practical with most continuous cutter and tunnelling machines. Since the rate of mineral extraction is related, not only to the rate of advancement of the continuous miner, but is significantly affected by the time it takes to secure the roof bolts or the like, as well as the time required to move the continuous miner for installation of the supplemental roof support, there is a clear need for a system to enable grid-like supplemental roof support material to be installed in a highly efficient, inexpensive, automated manner without interfering with the operation of the continuous miner equipment.

SUMMARY OF THE INVENTION

It is, therefore, a primary object of the present invention to provide an automatic grid layout device adapted for use in association with a continuous/miner bolter, roof bolter, tunnelling machine, or boring machine which overcomes all of the disadvantages set forth hereinabove, and others.

Another object of this invention is to provide a system of the type described adapted for continuously dispensing a mesh or grid material as the continuous miner is moved forwardly and rearwardly during a cutting cycle while insuring that installation of the supplemental support material will not interfere with the cutting mechanism or be damaged thereby.

A still further object of this invention is the provision of a grid-laying mechanism for use with a continuous miner which is designed to carry the grid in a roll sufficiently smaller than the width of the tunnel to avoid interference with the movement of the miner during the cutting operation, while dispensing a grid material sheet wider than the roll and sufficient to cover the entire width of the tunnel roof as it is unrolled.

In order to effect the foregoing, the polymer mesh material is unrolled from a grid dispenser carried by the pivotal boom arm of the continuous miner which includes the cutter drum, while the grid is maintained under a constant tension so that any slack or excess grid produced by movement of the miner during the cutting operation is retracted into the grid dispenser so as to avoid entanglement with the cutter drum.

While the width of the grid dispenser is less than the width of the cutter drum, the grid carried thereby is wider than the dispenser, including folded over longitudinally extending side sections temporarily secured in place by plastic cable ties. As the folded grid is withdrawn from the dispenser, the grid is passed over a spreader bar which unfolds the grid to its full width. Typically, the expanded width of the grid will approximate the width of the cutter drum so that the supplemental roof support material will cover the full width of the tunnel roof.

Preferably, commercially available sections of polymer mesh having widths of seven feet three inches and nine feet and a length of between 45 and 60 feet are overlapped along one longitudinal edge for a distance of approximately nine inches. The overlapped portions are connected to each other with stainless steel crimped connectors in two rows with a separation of approximately 12 inches between each connector in each row and with the two rows being staggered by a six inch separation.

The two sections thus form a polymer mesh sheet which is folded over at its outer longitudinal edges for a distance of approximately two feet three inches. The folded over edges are secured in place by eighteen pound plastic cables at a spacing of approximately 36 inches. One end of the formed sheet of polymer mesh is secured to a cylindrical shaft by 75 pound plastic cable ties extending through the end of the polymer mesh sheet into holes which are spaced along the shaft at a distance of every 12 inches.

The grid or mesh sheet is rolled on the centrally located shaft to a diameter of approximately 11.5 inches. The assembled roll is inserted into a grid dispenser box located on the boom of the miner cutter drum. Pins enter opposite ends of the shaft through the sidewalls of the grid dispenser box to rotatably mount the rolled grid sheet in the grid dispenser box. Mounted onto one of the pins holding the shaft of the rolled grid in place is a sprocket over which extends a chain. The chain extends to another sprocket mounted on the drive shaft of a hydraulic motor.

The motor includes a valve assembly which maintains the grid sheet in tension as the sheet is dispensed from the grid dispenser. Whenever less than a predetermined amount of pressure is sensed in the grid sheet, the valving assembly shifts and directs fluid against the hydraulic motor so as to withdraw the excess back into the grid dispenser. This eliminates any slack in the grid sheet and precludes contact of the sheet material with the cutter drum head.

The leading edge of the grid sheet extends from the dispenser and up over a spreader bar mounted between two temporary roof support pods. As the leading edge of the sheet material passes over the spreader bar, the relatively light weight, e.g., 18 pound, plastic cable ties securing the longitudinally folded side edges of the sheet in place, are broken. Advancement movement of the continuous miner with the grid sheet in tension, spreads out the grid sheet to its full width of 15.5 feet, the same width at the cutting drum of the continuous miner.

When progress of the continuous miner is stopped for bolt installation, four (4) automated temporary roof support (ATRS) jacks, two previously mentioned and a second downstream set of temporary roof supports, hold the supplemental roof support material against the ceiling as a roof bolt is installed. The roof bolt aids in stabilizing the mine roof while simultaneously securing the grid sheet in place by a six inch by six inch steel plate secured at a trailing end of the roof bolt.

Thus, as the continuous miner advances, the grid mesh sheet is unfolded to its full width for simultaneous automatic connection to the mine roof. Movement of the miner cutter boom does not adversely affect the removal of the grid sheet from the dispenser because of the automatic reversal of the relief/motor assembly. Slack grid is retracted onto the reel in the dispenser box thereby preventing "bagging" of the polymer grid sheet which could cause the same to be damaged by the rotating cutter head. Active tensioning also ensures that the folded ends of the grid mesh sheet will unfold during pay-out and refold during retraction procedures.

The connection of the spreader bar assembly to the front automated temporary roof support jacks allows even tensioning of the grid and a mechanical means to ensure that the folds of the grid sheet spread the same to its full width.

Alternatively, the present invention may be used independently of a continuous miner. In combination with an independent roof bolter, boring machine or tunneling machine, for example, grid material may be dispensed in tension, from the grid dispenser of the present invention for securing grid material in a pre-existing passageway or in a passageway formed other than by a continuous miner.

It is, therefore, another object of the present invention to provide a roll of grid material in a dispenser on a continuous miner wherein the sheet material is folded along its longitudinal edges to form a lesser width than the cutter head and which is automatically expanded to its full width approximating the width of the cutter head during advancement of the continuous miner. Consistent with this object, the folded grid sheet is spread to its full width by a spreader bar connected to temporary roof support pods of the continuous miner.

It is still yet another object of the present invention to provide a folded grid sheet material which is played out of a dispenser box in a tensioned condition as a continuous miner is advanced and which is retracted into the dispenser box upon a reduction in tension on the sheet material.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
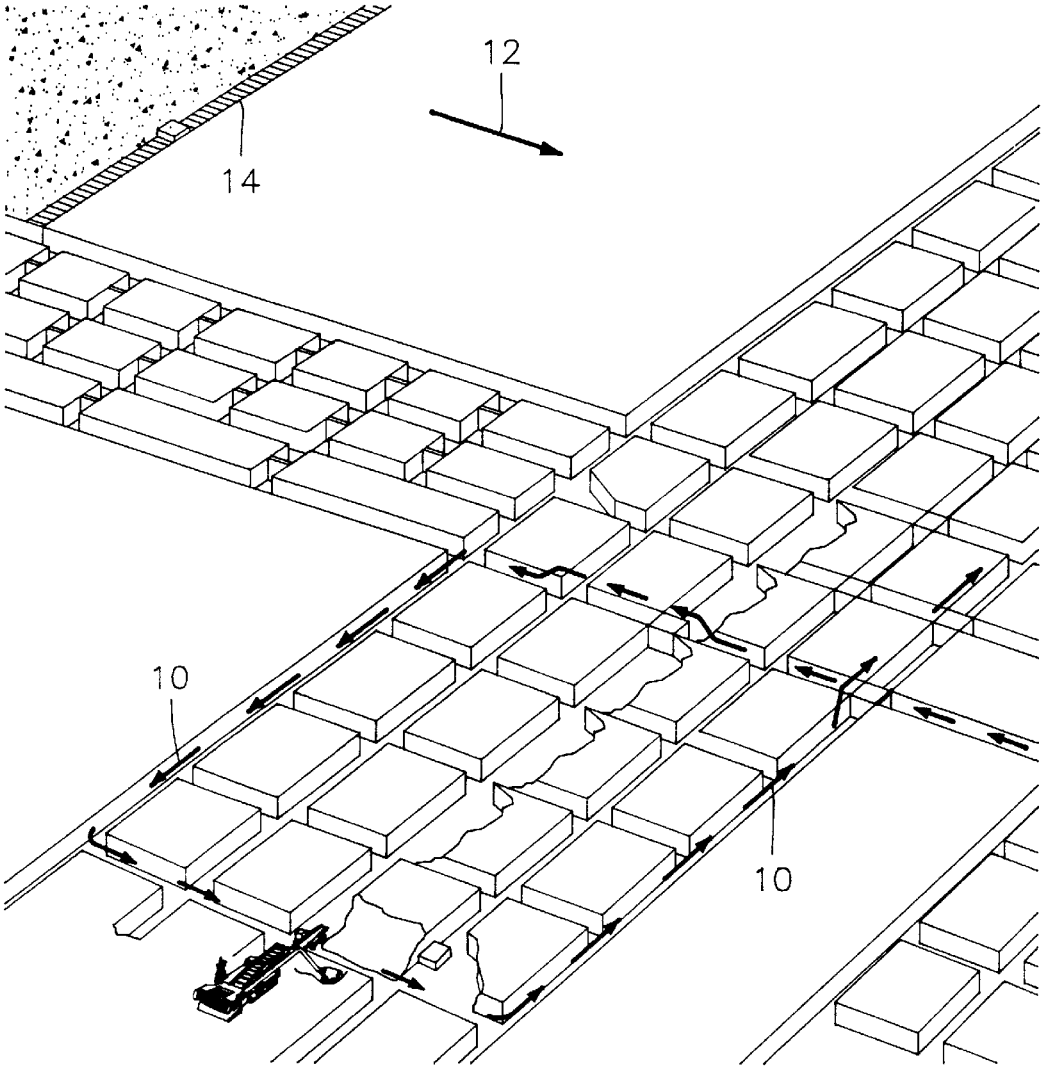
FIG. 1 is a conceptual representation of a typical mining operation as provided by Consol, Inc. of Pittsburgh, Pa.

In describing the preferred embodiments of the invention as illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
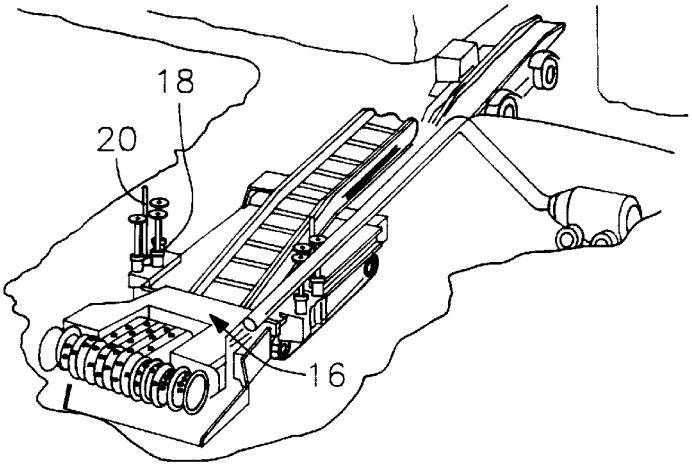
FIG. 2 is an enlarged view of the continuous mining system being implemented at one end of the mining operation shown in FIG. 1.
Figure 3:
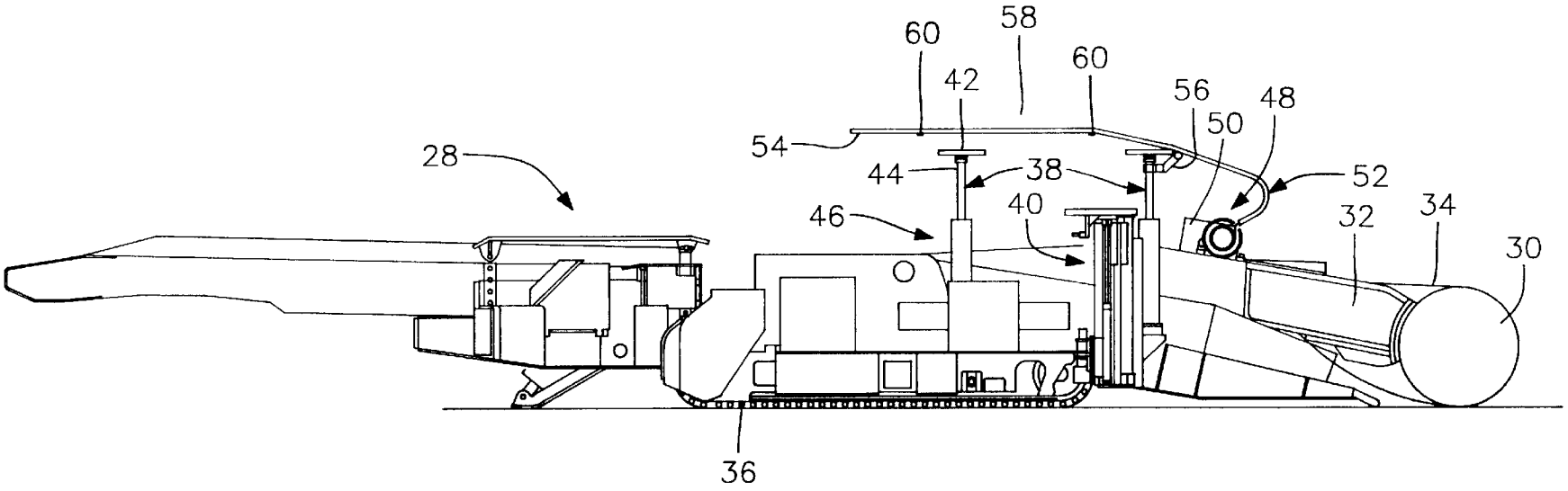
FIG. 3 is an elevational view of a continuous miner incorporating the automatic grid layout system of the present invention, including a grid dispenser box mounted on a boom of the continuous miner and illustrating the extension of a grid sheet across a spreader bar for positioning the same against the ceiling of an underground mine.
Figure 4:
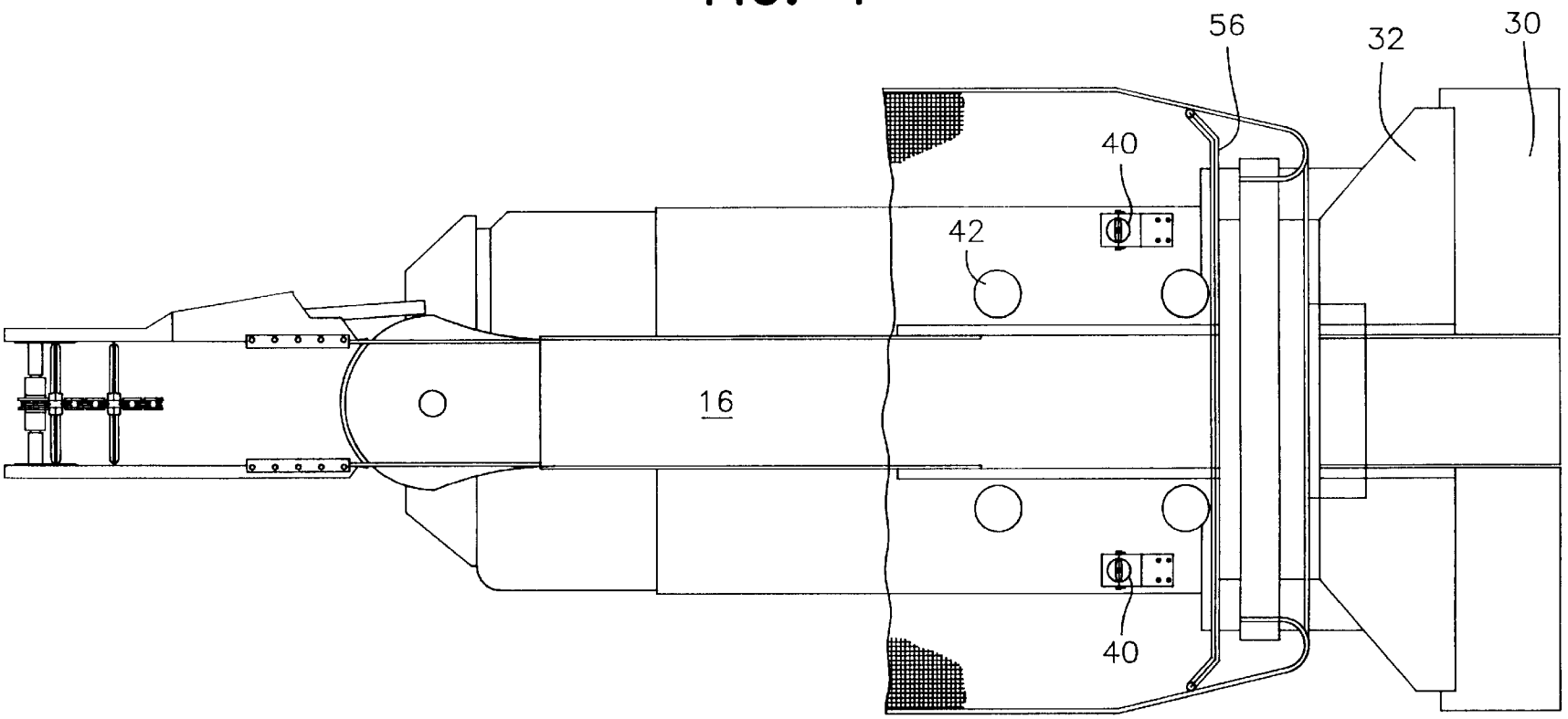
FIG. 4 is a plan view of the continuous miner shown in FIG. 3 which illustrates the expansion of a folded grid sheet to its full width as the sheet emerges from the dispenser box and across the spreader bar mounted on the temporary roof support pods.

FIGS. 1 and 2 are included to schematically illustrate the environment in which the automatic grid layout system of this invention is particularly useful.

In FIG. 1, an underground mine is shown including a plurality of passageways P representing mined passages for removal of minerals as well as for providing air flow as indicated by the arrows 10. A longwall mining system D is shown which advances in the direction of arrow 12 leaving gob E as the mining operation is performed in a back-and-forth operation along tracks 14.

The present invention is involved with the mining system I which uses a continuous miner J. The continuous miner J provides coal to a center conveyor 16. The conveyor 16 transports the coal to a loading machine L which in turn feeds the coal to a shuttle car M for movement along the passageway. A suction fan N removes coal dust adjacent to the continuous miner as it advances.

On both sides of the continuous miner J are located automated temporary roof supports (ATRS) K which in FIG. 2 include three support pods 18. A miner operator/roof bolt installer 20 is located amongst the support pods 18 for installing a mine roof bolt while the ceiling of the mine is supported by the support pods.

With reference to FIGS. 3 through 10, the present invention will be shown and described as installed on a continuous miner 28. The miner includes a cutter drum 30 mounted on a boom 32 and driven by a cutter chain 34 for rotation of the drum and cutting of a face of a coal seam. The boom 32 is raised and lowered as the continuous miner is advanced by tractor treads 36.

As is known, the continuous miner includes temporary roof supports 38 with two or three TRS's on each side of the miner. A mine roof bolt installing assembly 40 is located on both outer edges of the continuous miner 28. Each TRS 38 includes a circular plate 42 supported at a top of a piston 44 of a piston cylinder assembly 46.

Located on the boom 32 is a grid dispenser motor cover 48 and a grid dispenser cartridge 50 for dispensing a grid sheet 52. A leading edge 54 of the grid sheet 52 extends above a spreader bar 56. The spreader bar extends between two TRS's 38 located at a forward end of the continuous miner. The grid sheet 52 is secured to a ceiling 58 of a mine passageway by roof bolts 60.

Figures 5, 6:
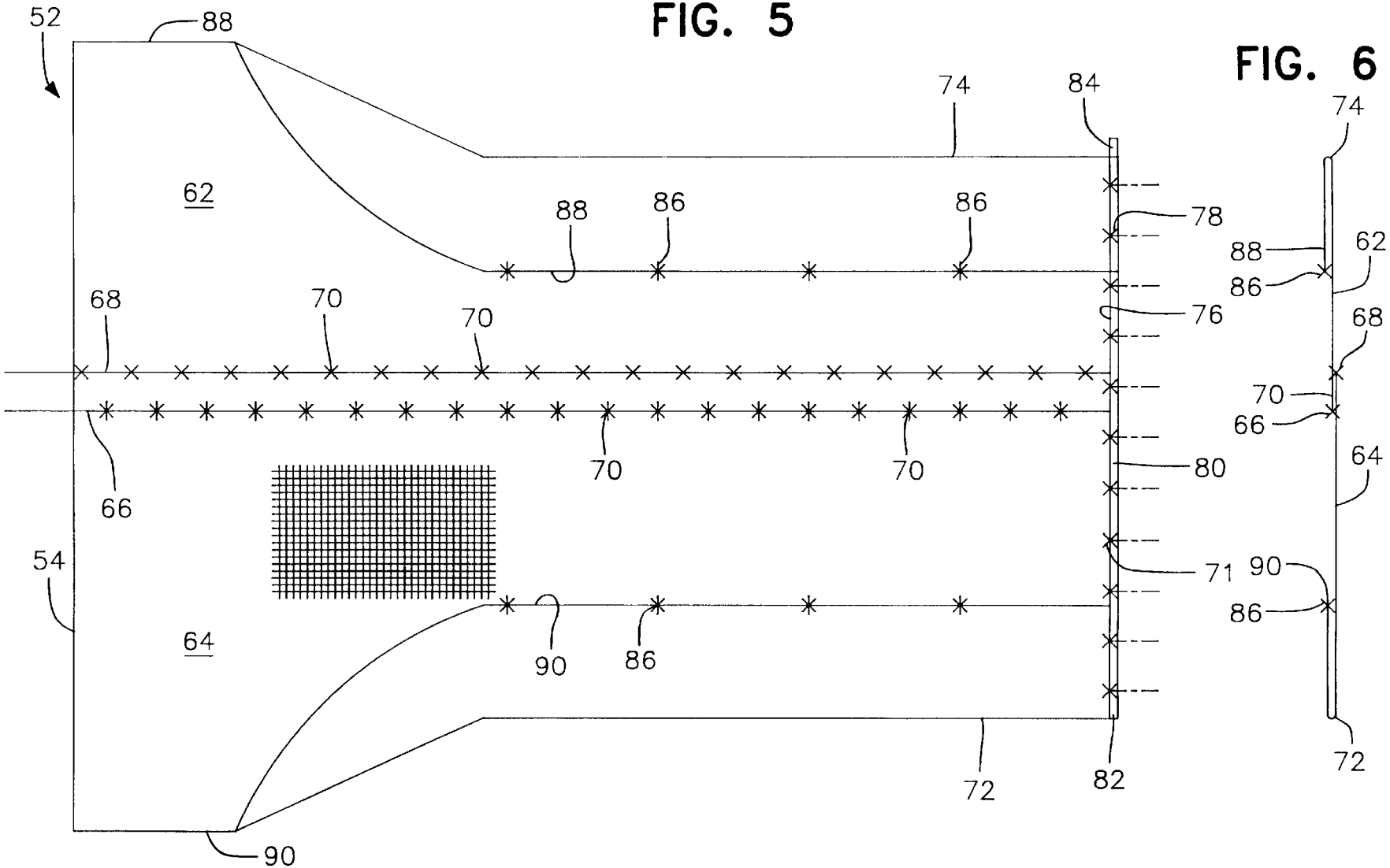
FIG. 5 schematically illustrates the connection of two sheets of grid material and the longitudinal folding of the edges of the joined sheet so as to roll the resulting material onto a shaft for placement within a grid dispenser box.
FIG. 6 is a side elevational view of the grid sheet showing the folded-over side portions.

In FIGS. 5 and 6, a grid sheet 52 as will be included in the grid dispenser cartridge 50 is shown. The sheet 52 is made of two sheet sections 62 and 64. Each of the sheet sections is preferably a biaxial grid commercially available from Tensar as product No. BX3316. Section 62 may comprise a width F of seven feet, three inches and a length B of 45 feet, although a length of 60 feet or more may be used based on variations, such as seam height, type of machine, etc. Sheet section 64 may have a width E of nine feet and a length B of 45 feet, although a length of 60 feet may be used. The foregoing widths and lengths are illustrative and are chosen since they are commercially available materials currently available from Tensar.

Internal edge 66 of sheet section 62 is laid over a portion of sheet section 64 terminating at edge 68. An overlap of approximately nine inches in the two sheets is secured together by stainless steel crimped connectors 70.

In an unfolded condition, the combined sheet sections 62 and 64 have an overall width A of 15 feet, 6 inches at leading edge 54. However, in the folded condition of the sheet sections, both sides of the combined mesh sheet 52 are folded inwardly along edges 72 and 74 for a distance D of about two feet, three inches. Accordingly, at a trailing edge 76, the width C of the sheet is about 11 feet.

In the inwardly folded condition of the sheet 52, at end 76, a plurality of 75 pound plastic cable ties 78 extend through the sheet and into 12 inch spaced holes in shaft 80. Shaft 80 has an overall length of 11 feet, four inches. One end 82, of the shaft 80 is lined up with folded edge 72 of the sheet. The opposite end 84 projects four inches beyond folded edge 74. To hold the folded portions of sections 62 and 64 onto itself, a plurality of 18 pound plastic cable ties 86 are spaced at a distance of 36 inches along the edges 88 and 90 of section 62, 64, respectively.

Figure 7:
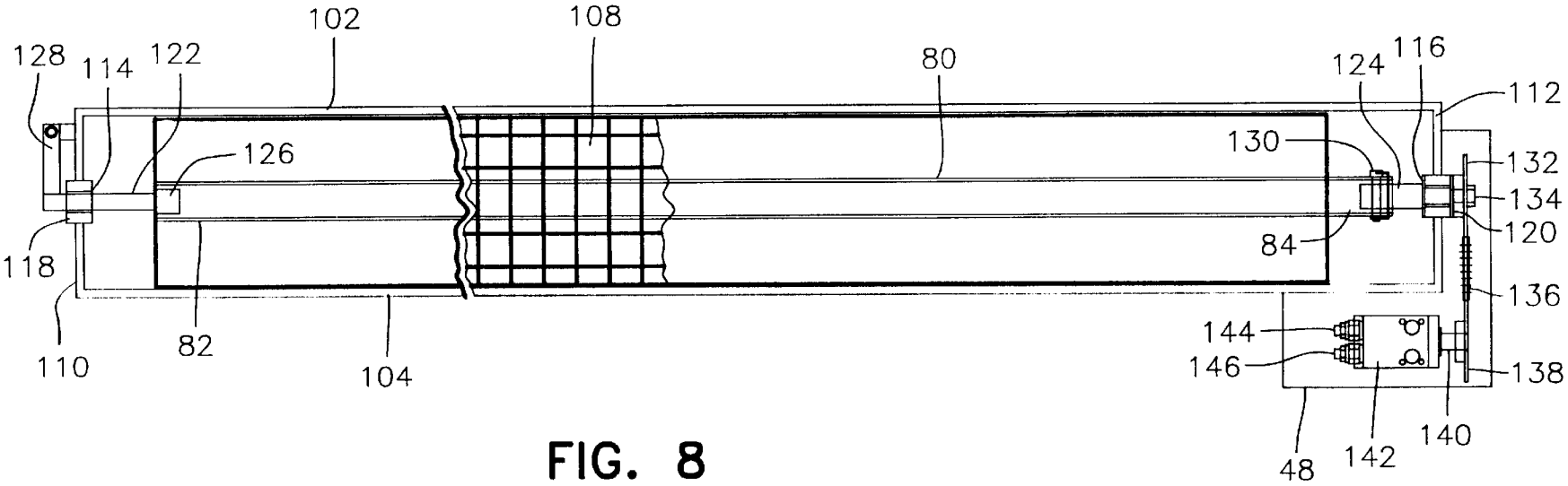
FIG. 7 illustrates a partial sectional view of a grid dispenser box having a roll of grid material mounted on a shaft and held in place in the box by opposing pins, with one of the pins operatively connected to a hydraulic motor for maintaining tension on the grid material as it is dispensed.
Figure 8:
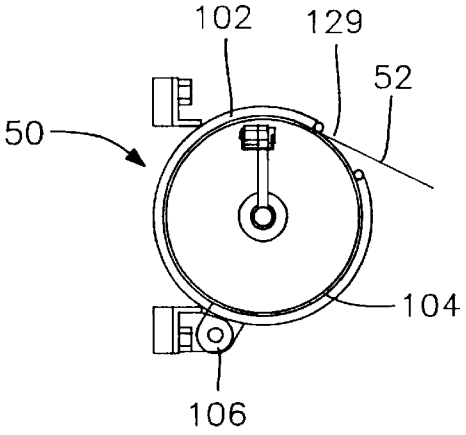
FIG. 8 is an end elevational view of the grid dispenser box of FIG. 7.

After attachment of the edges of the sections 62, 64 onto themselves, the reduced width sheet 52 is then rolled about shaft 80 to a diameter of approximately 11.5 inches. The roll of grid sheet 52 and its centrally located shaft 80, which is preferably made of PVC pipe, is placed in a three-part grid dispenser cartridge 50 as shown in FIGS. 7 and 8. The grid dispenser cartridge includes semi-circular portion 102 and another curved portion 104 pivotally mounted about hinge 106 on portion 102 to allow entry of the roll 108 of grid between the end walls 110, 112 of the grid dispenser cartridge 50.

The overall dimensions of the grid dispenser cartridge 50 is about 12 feet long, 12 inches wide and 12 inches high. Preferably, the grid dispenser is made of ⅜ inch thick steel plate.

Each end wall 110, 112 includes an opening 114, 116, respectively, and a bushing 118, 120, for receipt of a through-pin 122, 124 is fixed, respectively. At an end of pin 122 opposite to the end 126 which is engaged in end 82 of shaft 80, is located a handle 128 for initial manual movement of the leading edge 54 of roll 108 of mesh sheet through the gap 129 between the portions of cartridge 50.

At the opposite end of roll 108, pin 124 is fixed in position in bushing 120. End 84 of shaft 80 is angled to engage fixed pin 124. End 84 is then secured to fixed pin 124 by a lock pin 130. At the opposite end of pin 124 is located a sprocket 132 secured by a lock nut 134. Entrained about the sprocket 132 is a chain 136 which similarly surrounds a sprocket 138 located on an end of a drive shaft 140 of a hydraulic motor 142.

Figure 10:
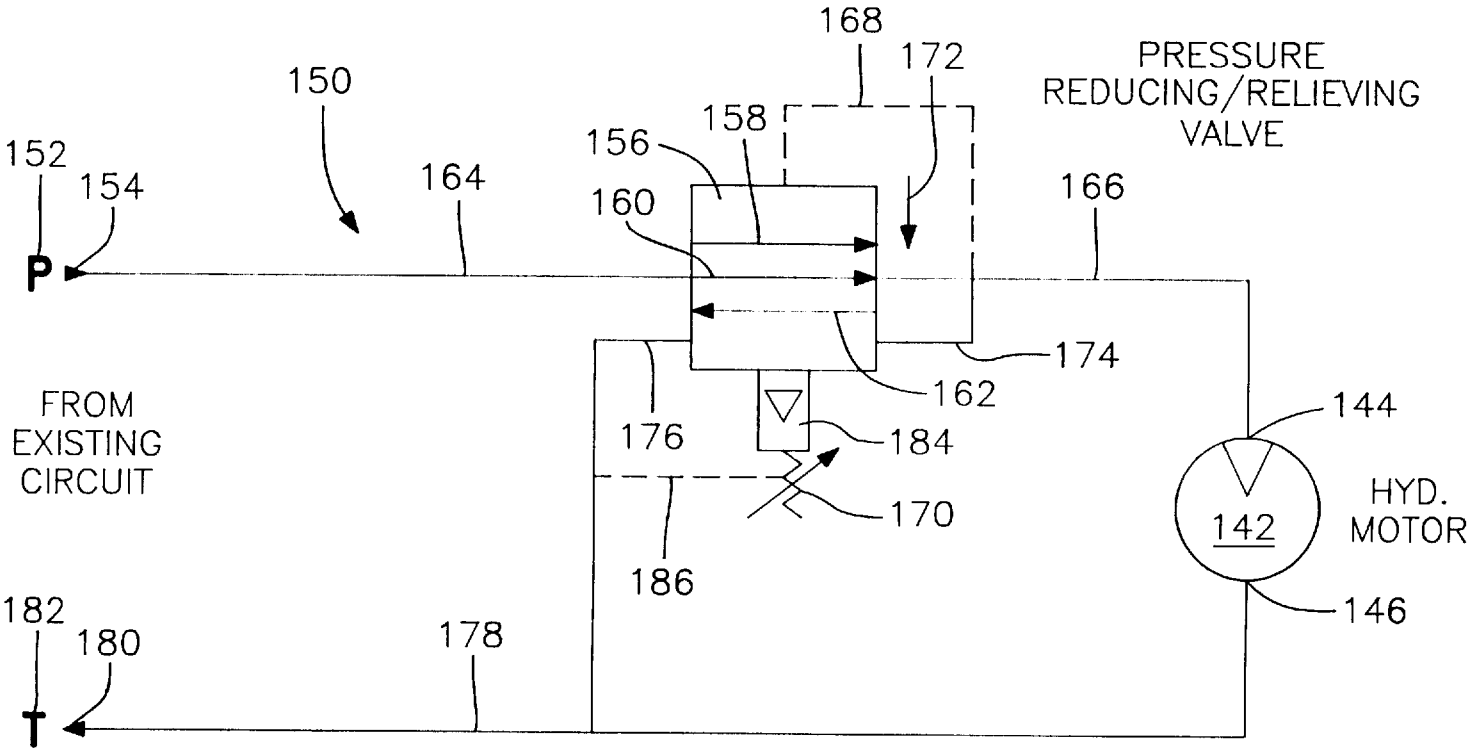
FIG. 10 is a schematic illustration of a hydraulic motor and a pressure reducing/relieving valve for controlling flow of hydraulic fluid to the motor and maintaining tension on the grid sheet.

By the valving arrangement connected to inlet 144 and the outlet 146 of hydraulic motor 142, as shown in FIG. 10, hydraulic motor 142 is continuously urged to rotate in a single direction. When the grid sheet is played out of the grid dispenser cartridge 50, the forces pulling the grid sheet out of the grid dispenser are stronger than the hydraulic forces rotating the motor. Accordingly, the grid sheet is pulled out of the grid dispenser at a constant tension on the grid sheet. When, due to the valving arrangement connected to the motor 142, the forces pulling grid sheet out of the cartridge are reduced, by discontinuance of advancement of the continuous miner, for example, the rotation of the motor shaft 140 causes the chain 136 on sprockets 138 and 132 to rotate the roll 108 back into the grid dispenser. The grid sheet 52 is moved back into the grid dispenser cartridge 50 to avoid the potential damaging contact with the cutting drum which could occur if the grid sheet were allowed to sag or bunch up.

As shown in FIG. 10, the hydraulic fluid flow arrangement 150 includes flow of hydraulic fluid from a pressurized source 152 in the direction of arrow 154 towards pressure-reducing/relieving valve 156. Valve 156 may be a valve commercially available from Command Controls, Part No. PRRS-10-N-S0-15 with a 30027 body.

Valve 156 includes three fluid flow lines 158, 160 and 162. Hydraulic fluid flows from the pressure source 152 through line 164 and into line 160 in the valve. The fluid passes through valve 156 and exits into line 166 to inlet 144 of hydraulic motor 142. Motor 142 is commercially available from Char-Lynn as Part No. H-46 ccm/rev. 101-1009. The fluid then flows out of the motor 142 via outlet 146 and into return line 178 connected to tank 182, with the fluid moving in the direction of arrow 180. In the condition of the circuit 150 shown in FIG. 10, a driving pressure is transmitted to the motor so as to rotate the motor in a direction so as to retract grid which has been moved from the grid dispenser, either because of a lack of forward progress of the continuous miner, or due to the elevation of the boom 32 at a rate faster than the forward progress of the continuous miner.

When the continuous miner starts again to move forward or the boom is lowered from an elevated position, grid will tend to be pulled out of the grid cartridge 50. The force of pulling the grid out of the cartridge due to movement of the continuous miner or movement of the boom, is greater than the force applied by the motor to retract grid back into the grid cartridge. Accordingly, due to the interconnection of the grid shaft and sprockets interconnected by a chain, the motor shaft is rotated in an opposite direction to the direction normally required to retract grid back into the grid cartridge.

The overriding force of grid being pulled from the cartridge causes the pressure of the hydraulic fluid in line 166, which feeds to the motor through inlet 144, to increase due to a forcible, counter-rotation of the hydraulic motor. Pressure increase is sensed in pressure sensing line 168 which, dependent upon the force of the pressure detected, overcomes the bias in spring 170 to force the valve 156 in the direction of arrow 172.

By the downward movement of valve 156, line 158 is caused to align with lines 164 and 166 and line 162 is caused to align with bypass lines 174 and 176. Accordingly, while hydraulic fluid will continue to pass to line 166 and to the hydraulic motor 142, the build up of pressure due to the force of pulling the grid out of the grid cartridge, will be relieved by bypass lines 174, 162 and 176 which are now in communication through valve 156.

When the continuous miner ceases advancement and moves in a reverse direction, the continuous pressure through line 166 actuates the motor 142 to continue its direction of rotation, which at this point, allows rotation of the motor to retract grid material back into the grid cartridge. Due to the rotation of the motor 142, hydraulic fluid in line 166 will be allowed to move to line 178. Accordingly, the pressure in lines 174, 162, 176 will drop. This pressure drop is sensed by pressure sensing line 186 which will allow the bias of spring 170 to force the valve 156 upward so as to break the communication in the bypass lines 174, 162, 176 and allow hydraulic flow from lines 164, 160 and 166 to the motor 142.

The amount of pressure required to change position of the valve 156 is regulated by control assembly 184. Control assembly 184 regulates the amount of pressure which will actuate spring 170 to allow reciprocal movement of valve 156 between the positions when the motor needs to retract grid material into the grid cartridge or where the rotation bias of the motor is sufficient to maintain tension on the grid material as it is being pulled out of the grid cartridge and thus overcome the rotational forces of the motor.

Figure 9:
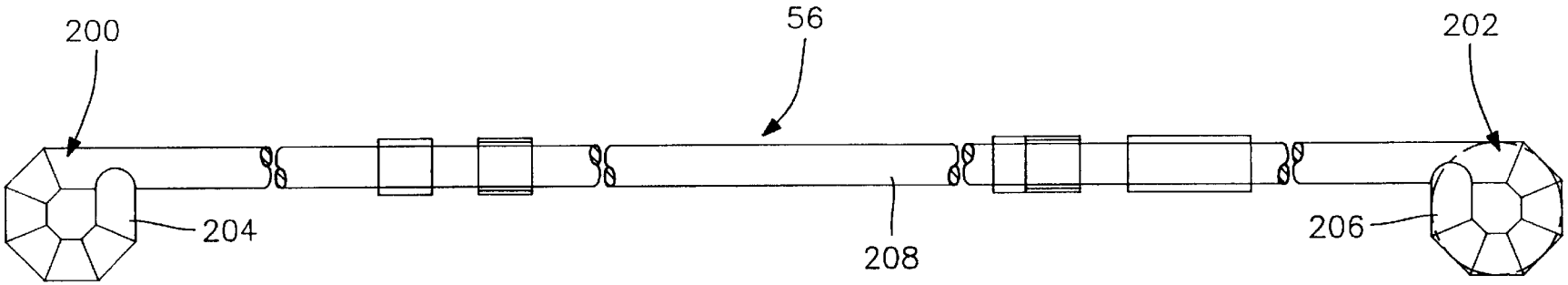
FIG. 9 is a plan view of a spreader bar which is to be mounted between the two front temporary roof supports on a continuous miner/bolter.

The maintenance of the tension on the grid sheet by hydraulic motor 142 aids in the separation of the folded-over portions of the grid sheet 52 as the grid sheet crosses over and engages the spreader bar 56. As shown in FIG. 9, the spreader bar 56 includes opposite ends 200, 202. Each end includes a curved section 204, 206, which extends partially over the straight bar portion 208 of the spreader bar. The spreader bar is preferably made of schedule 80 PVC or extended fiberglass pipe.

Accordingly, as the leading edge 54 of the grid sheet extends from the grid dispenser cartridge 50 and crosses the spreader bar 56, the tension maintained on the grid sheet is sufficient, in combination with the contact with the ends 200, 202 of the spreader bar 56 to break the cable ties 86, which retain folded-over portions of the grid sheet, and allow the same to open up into its full width of approximately 15 feet, 6 inches. This dimension is approximately the same width as the cutter drum on the continuous miner on which the assembly of the present invention is mounted. During bolt installation, TRS pods 38 are lifted to press the grid sheet onto the ceiling. The sheet is held in contact with the ceiling 58 for mechanically anchoring of the same on the ceiling by mine roof bolts 60.

Since the cutter drum 30 on the boom 32 is raised and lowered, damaging contact of the grid sheet with the cutter drum is avoided by maintaining a constant tension on the same by the hydraulic motor 142. The hydraulic motor thereby serves the dual purpose of maintaining a tension an the grid sheet for aiding in spreading of the folded-over portions and avoids contact of the grid sheet with the cutter drum as the cutter drum is raised and lowered.

Having described the invention, many modifications thereto will become apparent to those skilled in the art to which it pertains without deviation from the spirit of the invention as defined by the scope of the appended claims.

I claim:

1. In a grid layout system for use with a continuous miner including a cutting drum at its leading end adapted to cut a rock face to form a passageway having a floor, a ceiling, and opposed sidewalls extending between the floor and the ceiling, the improvement comprising:

a roll of grid material to be secured to the ceiling of the passageway, a grid dispenser mounted on the continuous miner behind the cutting drum, said grid dispenser supporting said roll of grid material and being adapted to dispense said grid material in a direction opposite to the primary direction of movement of the continuous miner when cutting the rock face to form the passageway, and a motor operatively connected to said grid dispenser for maintaining tension on said grid material as said grid material is dispensed from said grid dispenser and for retracting said grid material upon sensing a predetermined slack in the previously dispensed grid material to thereby avoid contact of said grid material with the cutting drum.

2. A grid layout system according to claim 1, wherein a temporary roof support assembly and a mine roof bolt assembly are carried by the continuous miner to hold and secure said grid material to the ceiling of the passageway.

3. A grid layout system according to claim 1, wherein said grid dispenser includes a centrally located rotatable shaft, and said grid material is rolled on said shaft.

4. A grid layout system according to claim 3, wherein said grid dispenser includes opposed sidewalls, pins extending through said opposed sidewalls of said grid dispenser securing said shaft in said grid dispenser, one of said pins having a first sprocket interconnected by a chain to a second sprocket mounted on a motor shaft of said motor.

5. A grid layout system according to claim 1, wherein said motor is a hydraulic motor driven by hydraulic fluid passing through a hydraulic circuit having a pressure reducing/relieving valve for controlling the direction of rotation of said roll of grid material.

6. A grid layout system according to claim 1, wherein the width of said grid dispenser is less than the width of said cutting drum.

7. A grid layout system according to claim 6, wherein the width of said roll of grid material is less than said width of said grid dispenser.

8. A grid layout system according to claim 1, wherein said grid material includes at least one longitudinally extending side edge portion folded over onto itself.

9. A grid layout system according to claim 8, wherein said at least one longitudinally extending side edge portion is secured in the folded condition.

10. A grid layout system according to claim 8, further comprising a spreader bar mounted on said continuous miner for opening up the folded grid material as said grid material is dispensed therefrom.

11. A grid layout system comprising:

a continuous miner for cutting a rock face to form a passageway having a floor, a ceiling, and opposed sidewalls extending between the floor and the ceiling, a grid dispenser mounted on said continuous miner, and a roll of grid material to be dispersed from said grid dispenser for lining the ceiling of the passageway, said grid material being an elongated sheet of grid material having at least one longitudinally extending side edge portion folded over onto itself, said grid material being expanded to its full width as said grid material is dispensed from said grid dispenser.

12. A grid layout system according to claim 11, wherein the continuous miner includes a forwardly extending cutting drum which defines the width of the passageway cut in the rock face, and the width of said roll of grid material is less than the width of said cutting drum.

13. A grid layout system according to claim 12, wherein said grid dispenser is mounted on a boom of said continuous miner, said cutting drum is also mounted on said boom for upward and downward movement of said cutting drum by movement of said boom.

14. A grid layout system according to claim 11, wherein opposed longitudinally extending side edge portions of said grid material are folded over onto the central portions of said grid material.

15. A grid layout system according to claim 11, wherein said at least one longitudinally extending side edge portion is secured to itself.

16. A grid layout system according to claim 15, wherein said at least one longitudinally extending side edge portion is secured to central portions of said grid material with cable ties.

17. A grid layout system according to claim 11, further comprising a spreader bar mounted on said continuous miner, said spreader bar contacting said grid material as said grid material is dispensed from said grid dispenser to unfold said at least one longitudinally extending side edge portion.

18. A grid layout system according to claim 17, wherein said spreader bar extends across said continuous miner and includes curved ends.

19. A grid layout system according to claim 11, wherein said grid material is biaxial geogrid.

20. A grid layout system according to claim 11, wherein a temporary roof support assembly and a mine roof bolt assembly are mounted on said continuous miner for holding and securing the grid material on the ceiling of the passageway.

21. A grid layout system comprising:

a continuous miner for cutting a rock face to form a passageway having a floor, a ceiling, and opposed sidewalls extending between the floor and the ceiling, a cutting drum located at a leading end of said continuous miner, a grid dispenser mounted on said continuous miner, a roll of grid material dispensed from said grid dispenser for lining the ceiling of the passageway, said grid material being an elongated sheet of grid material having at least one longitudinally extending side edge portion folded over onto itself, said grid material being expanded to its full width as said grid material is dispensed from said grid dispenser, and a motor connected to said grid dispenser for maintaining tension on said grid material as said grid material is dispensed from said grid dispenser and for retracting said grid material into said grid dispenser upon sensing excessive predetermined slack present in the dispensed grid material so as to avoid contact of said grid material with said cutting drum.

22. A grid layout system according to claim 21, wherein a cutting drum mounted on said continuous miner defines the width of the passageway cut in the rock face and the width of said roll of grid material is less than the width of said cutting drum.

23. A grid layout system according to claim 21, wherein two longitudinally extending side edge portions of said grid material are folded over onto themselves.

24. A grid layout system according to claim 21, wherein a spreader bar mounted on said continuous miner contacts said grid material as said grid material emerges from said grid dispenser and unfolds said at least one longitudinally extending side edge portion.

25. A grid layout system according to claim 21, wherein said at least one longitudinally extending side edge portion is secured with cable ties.

26. A grid layout system according to claim 21, wherein said grid dispenser is mounted on a boom of said continuous miner, said cutting drum is also mounted on said boom for upward and downward movement of said cutting drum by movement of said boom.

27. A grid layout system according to claim 21, wherein said grid material is biaxial geogrid.

28. A grid layout system according to claim 21, wherein a temporary roof support assembly and a mine roof bolt assembly are mounted on said continuous miner for holding and securing the grid material on the ceiling of the passageway.

29. A grid layout system for use in a passageway having a floor, a ceiling, and opposed sidewalls extending between the floor and the ceiling, said system comprising:

a roll of grid material to be secured to the ceiling of the passageway, at least one longitudinally extending side edge portion of said grid material being folded over onto itself to define a first width, a grid dispenser mounted on a mobile mining apparatus for supporting said roll of grid material and being adapted to dispense said grid material for mounting on the ceiling, said grid dispenser defining a second width, a third, unfolded width of said roll of grid material being greater than said first width and said second width so that said grid material can occupy a greater width mounted on said ceiling than said first width and said second width after said grid material is dispensed from said grid dispenser, and a motor operatively connected to said grid dispenser for maintaining tension on said grid material as said grid material is dispensed from said grid dispenser and for retracting said grid material toward said grid dispenser upon sensing a predetermined slack in the previously dispensed grid material.

30. A grid layout system according to claim 29, wherein said grid dispenser includes a centrally located rotatable shaft, and said grid material is rolled on said shaft.

31. A grid layout system according to claim 30, wherein said grid dispenser includes opposed sidewalls, pins extending through said opposed sidewalls of said grid dispenser securing said shaft in said grid dispenser, one of said pins having a first sprocket interconnected by a chain to a second sprocket mounted on a motor shaft of said motor.

32. A grid layout system according to claim 29, wherein said motor is a hydraulic motor driven by hydraulic fluid passing through a hydraulic circuit having a pressure reducing/relieving valve for controlling the direction of rotation of said roll of grid material.

33. A grid layout system according to claim 29, wherein said at least one longitudinally extending side edge portion is secured in the folded condition.

34. A grid layout system according to claim 29, further comprising a spreader bar for opening up the folded grid material as said grid material is dispensed from said grid dispenser.

* * * * *